US010286437B2

(12) United States Patent
Golding

(10) Patent No.: US 10,286,437 B2
(45) Date of Patent: May 14, 2019

(54) ANTI-WRINKLING TOOLING ASSEMBLY FOR A CAN BODYMAKER

(71) Applicant: CROWN Packaging Technology, Inc., Alsip, IL (US)

(72) Inventor: Richard Mark Orlando Golding, Mount Prospect, IL (US)

(73) Assignee: Crown Packaging Technology, Inc., Alsip, IL (US)

( * ) Notice: Subject to any disclaimer, the term of this patent is extended or adjusted under 35 U.S.C. 154(b) by 550 days.

(21) Appl. No.: 15/015,635

(22) Filed: Feb. 4, 2016

(65) Prior Publication Data

US 2017/0225217 A1 Aug. 10, 2017

(51) Int. Cl.

| | |
|---|---|
| ***B21D 22/28*** | (2006.01) |
| ***B21D 22/30*** | (2006.01) |
| ***B21D 51/26*** | (2006.01) |

(52) U.S. Cl.
CPC ..... *B21D 22/30* (2013.01); *B21D 22/28* (2013.01); *B21D 51/26* (2013.01)

(58) Field of Classification Search
CPC ..... B21D 22/30; B21D 22/28; B21D 51/26
See application file for complete search history.

(56) References Cited

U.S. PATENT DOCUMENTS

2015/0239029 A1 8/2015 Yamamoto et al.

FOREIGN PATENT DOCUMENTS

| | | |
|---|---|---|
| JP | H10-0272526 A | 10/1998 |
| WO | WO 95/05253 A1 | 2/1995 |

*Primary Examiner* — Teresa M Ekiert
(74) *Attorney, Agent, or Firm* — BakerHostetler

(57) ABSTRACT

Redraw tooling includes a punch tool, a punch ring that is retractable relative to the punch tool, a punch sleeve, and a spring or resilient material that urges the punch ring forward. Retracting the punch ring provides support for the redraw chine to diminish wrinkling.

24 Claims, 10 Drawing Sheets

ANTI-WRINKLING TOOLING ASSEMBLY FOR A CAN BODYMAKER

BACKGROUND

Many food can bodies and nearly all beverage can bodies are formed in a drawing and ironing ("D&I") process, also known as a drawing wall ironing ("DWI") process. DWI beverage cans are typically formed from a 3000 series aluminum alloy.

Conventional DWI aluminum beverage cans are often formed by first drawing a flat, circular blank into a cup in a dedicated machine known as a cupper. The cup then is inserted into another machine known as a bodymaker where the cup undergoes a redrawing process before wall ironing.

In a conventional redrawing process in a bodymaker, the cup is reduced in diameter and increased in length. The redrawn cup typically includes a flat bottom, a short angled wall that extends from the flat bottom, and a cylindrical sidewall that extends an end of the short angled wall, as shown in prior art FIG. 1*a*.

Conventional redraw tooling includes a punch assembly 110 that includes a center punch tool 112 and an annular punch sleeve 114 that pushes the cup through a die (not shown in the FIGS. 1*a* and 1*b*). The die has a cylindrical bore that receives the center punch tool and punch sleeve.

Punch tool 112 has a nose 120 that contacts a bottom of the drawn cup. Nose 120 includes a tip 122 that is the distal-most portion of tool 112. A nose outer surface 124 extends outwardly and rearwardly from tip 122.

Punch sleeve 114 is typically ifs affixed to center punch tool 112 and includes a tapered punch sleeve nose 140 that is rearward (that is, in the direction of relative motion of the tooling assembly 10 during the redrawing operation) of punch tool tip 122 and at least a portion of punch tool nose outer surface 124. A punch sleeve inner cylindrical surface 146 surrounds center punch tool outer cylindrical surface 126

FIG. 1*b* Illustrates the tooling after a cup has been redrawn. In this regard, the redrawn cup is an intermediate product that includes a bottom 104, a redraw chine 105, and a sidewall 106.

After the redrawing process, the punch assembly 110 pushes the cup through a series of dies (that is, the ironing process) to reduce the thickness of the sidewall. At the end of the ironing process, a doming tool 210 (FIG. 2) deforms the cup bottom 104 into the well-known dome on the bottom of a beverage can, which includes a dome and a base inner wall. A chine tool component 214 deforms redraw chine 105 into the well-known chine shape of commercial aluminum beverage cans.

Tooling having spring-supported parts is known in the art, which parts tend to perform a function of deforming the workpiece. The inventor however has identified problems that make wrinkling of the redraw chine more likely. First, the trend toward thinner aluminum blanks reduces the inherent ability of the material to resist wrinkling. Second, the trend toward lightweight beverage can ends (that is, the seamed-on component at the end opposite the base) having a smaller center panel diameter has resulted in a change in base configuration.

SUMMARY OF THE INVENTION

Redraw tooling for a can bodymaker includes redraw tooling that includes a punch ring, which is positioned between the center punch tool and the punch sleeve. The punch ring contacts the wall of the cup to inhibit or prevent wrinkling that can occur when redrawing the cup using thin metal blanks. The retractable punch ring preferably inhibits wrinkling without significantly deforming the chine wall, such as not leaving a groove or bow in the chine wall. The metal cups are an intermediate structure that is formed into a can body, such as a drawn and ironed beverage can body.

The punch ring is supported by a compliant support, such as a spring plate, or other spring structure, or resilient material, such as an elastomer. The compliant support positions the punch ring to contact the wall, preferably the angled wall, of the metal during redrawing. Later, after the wall ironing process, the compliant support can be deformed (as in spring compression or elastomer compression or in retracting one part relative to another) when the doming tool contacts the metal to form the dome.

Accordingly, a redrawing tooling assembly in a can bodymaker for redrawing a metal cup comprises: a center punch tool, a punch sleeve, a punch sleeve, and a compliant support.

The punch ring is concentric with the center punch tool, outboard of at least a portion of the center punch tool, and inboard of at least a portion of the punch sleeve. The punch ring has a contact surface that is radially located between the punch sleeve forwardmost tip and the punch sleeve contact surface. The punch ring contact surface is adapted to contact the chine wall of the metal cup during the redraw process.

The compliant support is configured to axially position the punch ring contact surface to contact the chine wall of the metal cup during the redrawing process to inhibit metal wrinkling. The compliant support is deformable in response to the punch ring engaging doming tooling in the bodymaker, thereby enabling the punch ring to retract relative to the center punch tool.

Preferably, the compliant support extends circumferentially around a portion of the center punch tool and contacts a base of the punch ring to urge the punch ring forward. The punch ring can include (i) an angled contact surface configured to contact a chine wall of a can and (ii) an inboard shoulder that is urged against an undercut shoulder of the punch tool by the compliant support, and may include a punch ring undercut shoulder. The undercut shoulder is configured to contact a land surface of the punch sleeve in a fully retracted position of the punch ring.

Optionally, the compliant support is retained by a groove in the center punch tool and the compliant support bears on a portion of the center punch tool. The compliant support preferably is a spring plate. The compliant support may also include a resilient elastomer.

The punch tool has a forwardmost annular tip adapted for concentric contact with a base of a metal cup during the redraw process preferably such that the punch ring engages the metal cup after the center punch tool, and the punch sleeve engages the metal cup after the punch ring. The punch sleeve is concentric with the center punch tool and has a contact surface that is axially located rearward of the center punch tool forwardmost tip such that the metal cup has an angled chine wall therebetween during the redrawing process. The punch tool forwardmost tip preferably is forward (that is relative in an axial direction) of the contact surface of the punch ring contact surface such that the punch ring contact surface initially contacts the chine wall at the chine wall angled surface after the chine wall angled surface is formed by the action of the tooling.

According to another aspect of the invention, a method of forming a metal can body includes the steps of redrawing a metal cup, ironing the sidewall, and forming a dome. The redrawing step includes contacting a bottom of the cup with a concentric center punch tool and contacting the chine wall of the metal cup with a punch ring, which has a compliant support, to inhibit wrinkling of the chine wall. This step reduces the diameter of the metal cup and forms an angled chine wall between the bottom of the metal cup and a sidewall of the metal cup. Preferably, the center punch tool contacts the metal cup before the punch ring contacts the metal cup such that the punch ring contacts the angled portion (that is, the angled portion of the chine wall is already from in the base before the punch ring contacts it).

Alternatively, the punch ring may contact the cup base before the punch ring contacts the metal base. In this regard, in the embodiment in which the punch ring contacts the metal cup before the punch tool, the specification uses the phrase "contacts the chine wall" because the punch ring contacts the portion of the base that forms the chine wall. Accordingly, the punch ring may contact the flat chine wall of the cup, as distinguished from the angled chine wall.

The ironing step includes ironing the sidewall by pushing the center punch tool through ironing rings. The doming step includes forming a dome in the bottom of the cup including contacting the bottom of the cup with doming tooling such that the doming tooling compresses the compliant support.

Preferably, the compliant support urges an inboard shoulder of the punch ring into contact with an undercut shoulder of the punch tool until, during the redrawing step until the punch ring retracts relative to the punch tool. Alternatively, the punch ring can be spaced apart from the undercut shoulder of the punch tool. Upon doming, the punch ring can retract until an outboard undercut surface of the punch ring contacts a land surface of the punch sleeve.

DETAILED DESCRIPTION OF PREFERRED EMBODIMENT

Figure 1A:
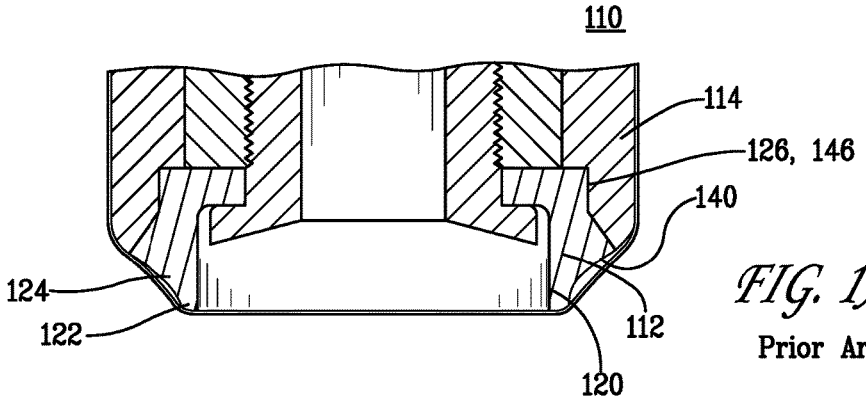
FIG. 1A Prior Art
FIG. 1*a* is a cross sectional view of prior art punch assembly tooling
Figure 1B:
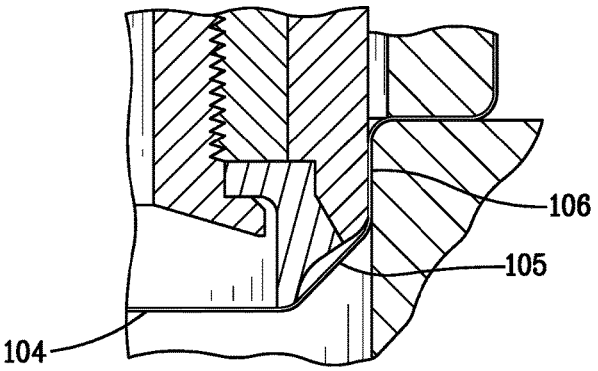
FIG. 1B Prior Art
FIG. 1*b* is a cross sectional view of prior art redraw tooling.
Figure 2:
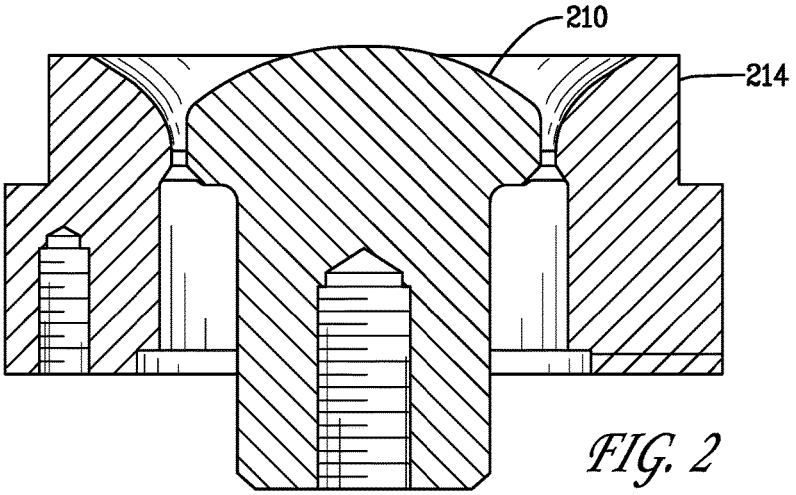
FIG. 2 Prior Art
FIG. 2 is a cross sectional view of prior art doming tooling.

Redraw tooling 10 according to an embodiment of the present invention is adapted for use in a can body maker. The bodymaker preferably receives a cup and first performs a redrawing operation using redraw tooling 10. Alternatively, the bodymaker may receive a flat blank and performs a drawing operation using tooling 10.

Tooling assembly 10 is on the distal end of a ram. After the redrawing step, the ram pushes the tooling assembly and cup through a series of dies to iron the cup sidewall, and thus transforms the cup into a can body or container body. When the can body is a beverage can body and when the ram is at the end of its stroke, the can body is pushed into doming tooling to form the dome, standing ring, and chine, as will be understood by persons familiar with method for forming beverage can bodies. The doming process well known in the art.

Tooling assembly 10 includes a center punch tool 12, a punch sleeve 14, a punch ring 16, and a compliant support, such as spring plate 76. Center punch tool 12 has circular, ring-like punch tool nose 20 at its forwardmost or distal most end. Center punch tool 12 has a hollow recess (not shown in the figures) radially inboard of nose 20 to receive doming tooling during the doming operation. The distal end of punch tool nose 20 forms a nose tip 22 about which the standing ring of the beverage can base is formed, a nose outer surface 24 that extends radially outwardly and rearward or proximally from tip 22, a cylindrical center punch tool outer surface or sidewall 26 that extends rearwardly from nose outer surface 24. The diameter of the largest part of outer surface 24 is greater than the diameter of punch tool sidewall 26 such that an undercut shoulder 25 is formed. Punch sleeve 14 preferably is fixed relative to punch 12 such that the sleeve 14 and punch 12 move together in the bodymaker. Punch sleeve 14 includes a distal punch sleeve nose 40, a punch sleeve inner cylindrical surface 42, a distal or forward-facing stop surface or landing or shoulder contact surface 43, a rounded or tapered surface 44, a punch sleeve outer cylindrical surface 46, a recess shoulder surface 47 and a punch sleeve cutout or recess 48. A portion of punch sleeve inner cylindrical surface 42 is in contact with or corresponds to a portion center punch outer surface 26. Sleeve inner surface 46 also includes a forward-facing shoulder 49 on which a proximal end of center punch 12 is located.

Punch sleeve outer cylindrical surface 46 extends distally (forwardly) to yield to angled or tapered surface 44 that extends to punch sleeve nose 40. Forward-facing landing 43 as shown in the figures is flat and extends radially inwardly and recessed relative to nose 40. The cylindrical or axial part of wall 47 and the radial part of wall 47 form recess or cutout 48, which together with the outer surface 26 of the center punch tool form a recess to house the rear portion of ring 16 and spring plate 76.

Figure 3:
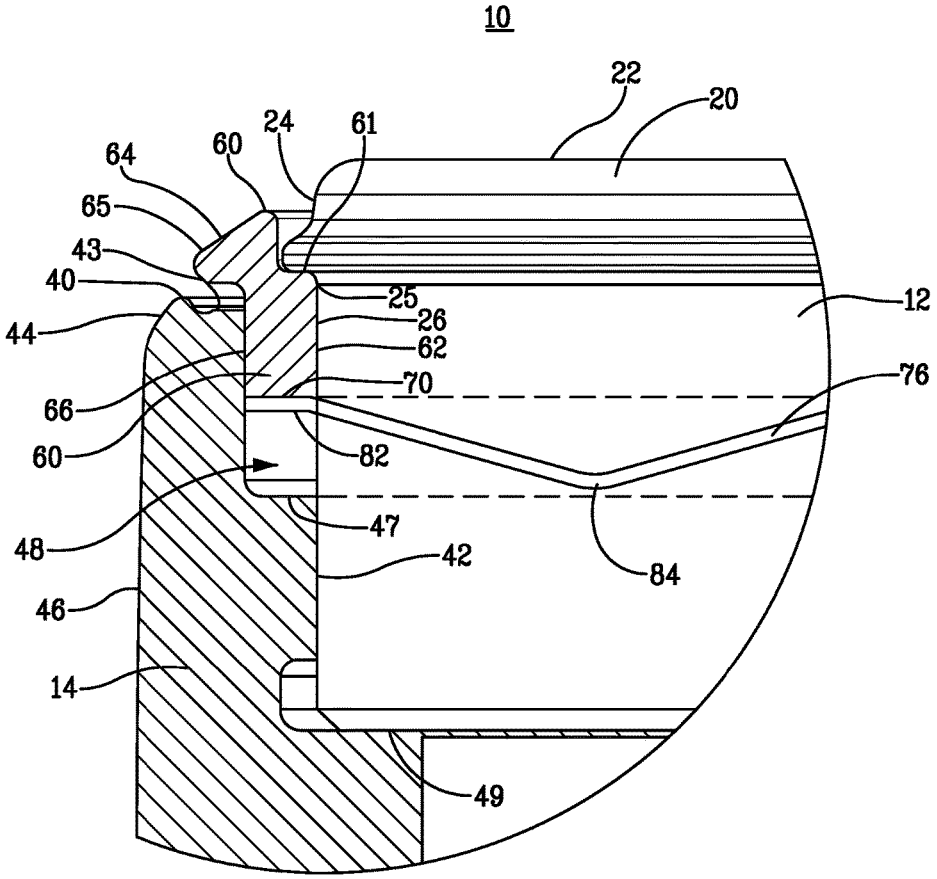
FIG. 3 is a cross sectional view of punch assembly tooling according to an embodiment of the present invention.

Punch ring 16 preferably has an overall ring-like shape and includes a nose 60, an inboard shoulder 61, an inner surface 62, an angled surface 64, an undercut shoulder 65, an outer surface 66, and a rear surface 70. Punch ring inner surface 62 preferably is cylindrical and is in sliding contact with or corresponds to a distal surface of center punch outer surface 26. Punch ring inner surface 62 extends distally to inboard shoulder 61, which may be contact with punch tool shoulder 25, as the compliant support urges punch ring 16 forward. Or punch ring inboard shoulder 61 may be spaced apart from punch tool shoulder 25. Punch 16 extends distally from shoulder 61 to a rounded punch nose 60. Angled surface 64 extends radially outwardly and rearwardly (or proximally) from nose 60 to an undercut and to (preferably) cylindrical punch ring outer surface 66. Angled surface 64 in the embodiment shown in FIG. 3 is flat or linear.

Compliant support, such a spring plate 76, has a radially inboard portion surface that extends around the circumference of punch tool outer surface 26. Spring plate 76 is wavy around its circumference such that the crests 82 of the upper surface plate 76 contact the base or rear surface 70 of punch ring 16 and the lower surface of the troughs 84 contact the shoulder 47 of punch sleeve recess 48. Crests 82 and troughs 84 retain plate 76 in punch sleeve recess 48.

As explained below, an outboard portion of plate 76 can engage an inner wall of the punch. Spring plate 76 can have inboard and outboard clearance and spring properties according to the particular parameters desired for the application. Because spring plate 76 is compliant, punch ring 16 can be pushed rearwardly by the doming tooling assembly as explained more fully below. The compliant support my be formed in any configuration, and encompasses any compliant material, such as an elastomer or other resilient material.

Figure 4:
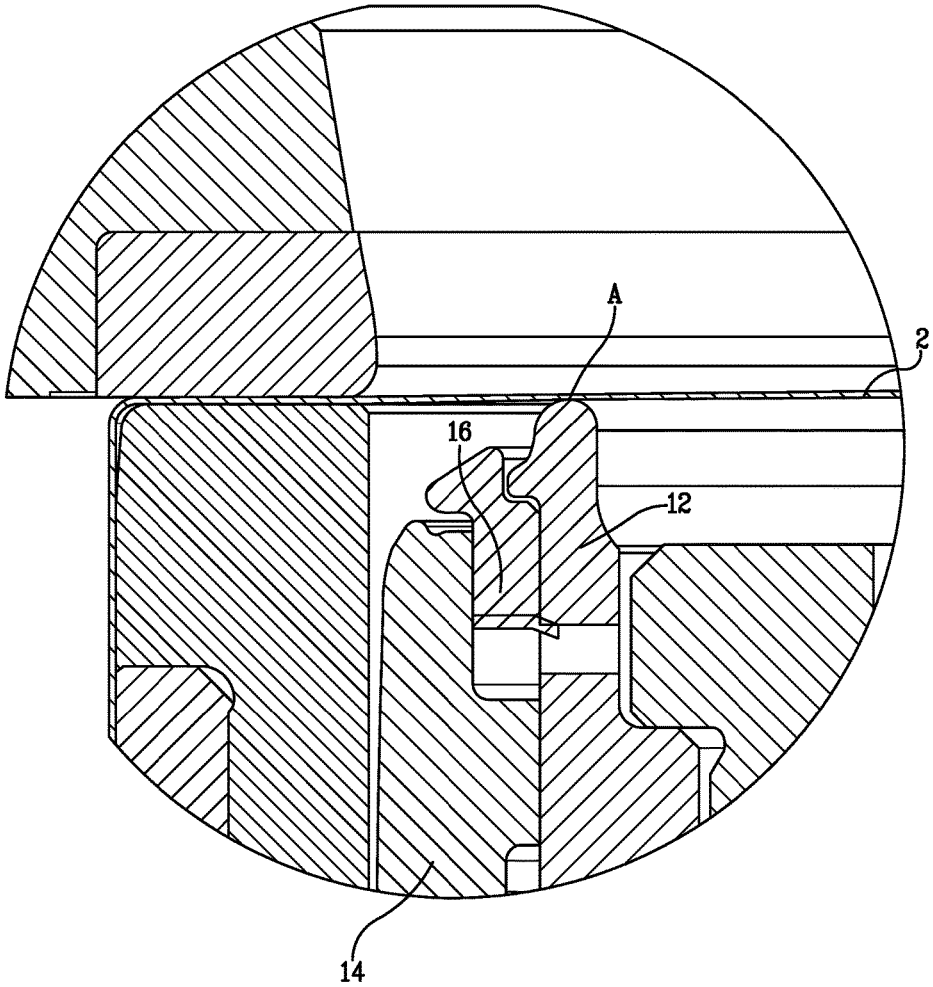
FIG. 4 is a view of the components of FIG. 3 illustrating the first point of contact point of the tooling with the can.

Referring to FIGS. 4 through 7 to illustrate the operation of tooling 10 during a drawing or redrawing step, center punch nose 20 moves forward relative to cup 2 until it engages a bottom of the cup 2 to begin the drawing/redrawing process. FIG. 4 illustrates the first point A at which the tooling at punch nose 20 touches or engages the can bottom 4. At this point, spring plate 76 urges punch ring base 70 to urge punch ring 16 forward such that punch ring inboard shoulder 61 is in contact with undercut shoulder 25 of punch tool 12. Or punch ring 16 may be positioned such that punch ring inboard shoulder is spaced apart from undercut shoulder 25.

Figure 5:
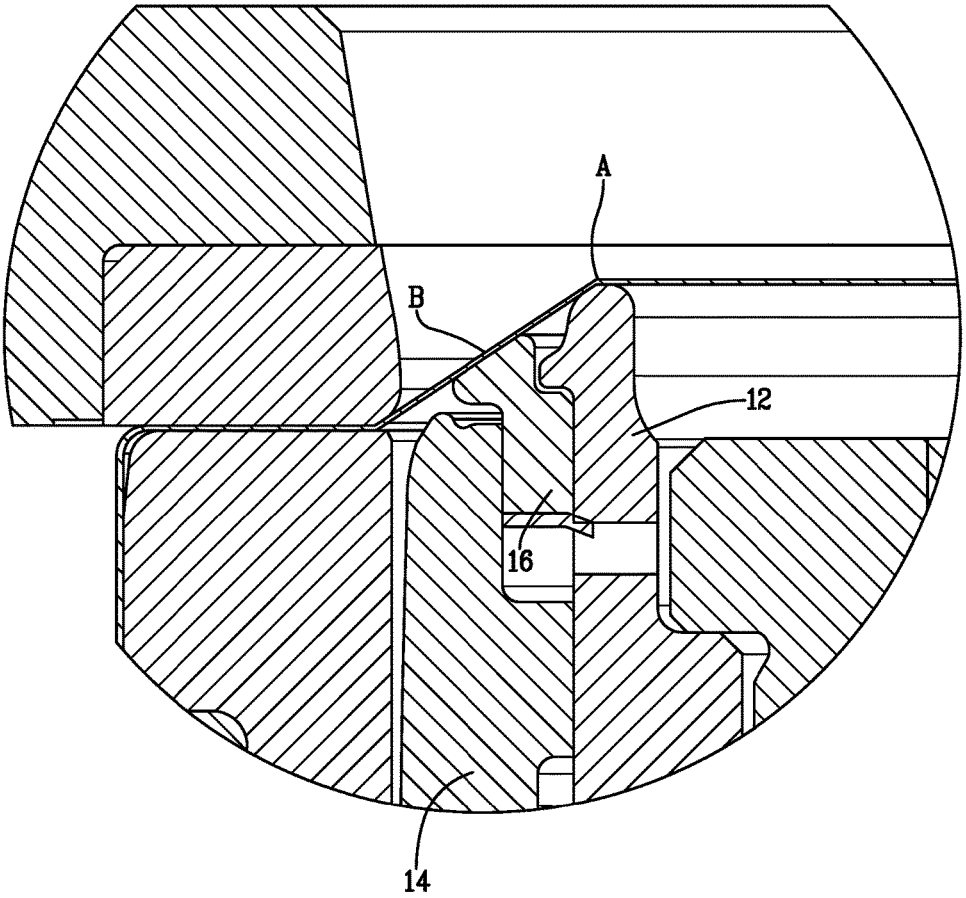
FIG. 5 is a view of the components of FIG. 3 illustrating the second contact point of the tooling with the can.
Figure 6:
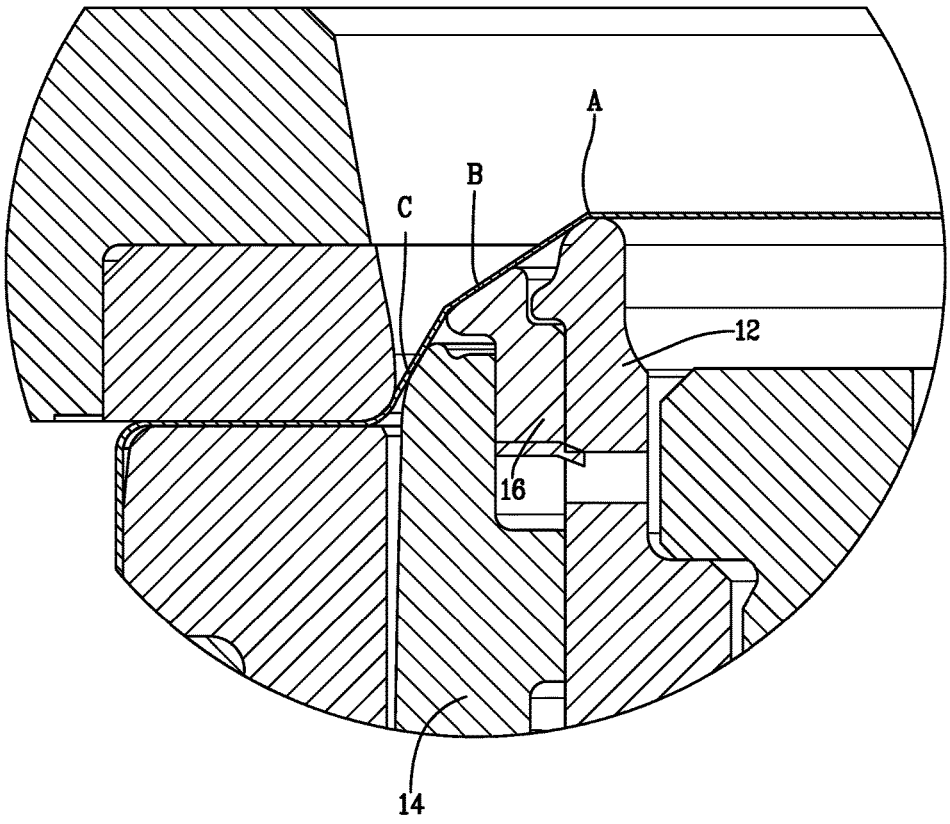
FIG. 6 is a view of the components of FIG. 3 illustrating the third contact point of the tooling with the can.
Figure 7:
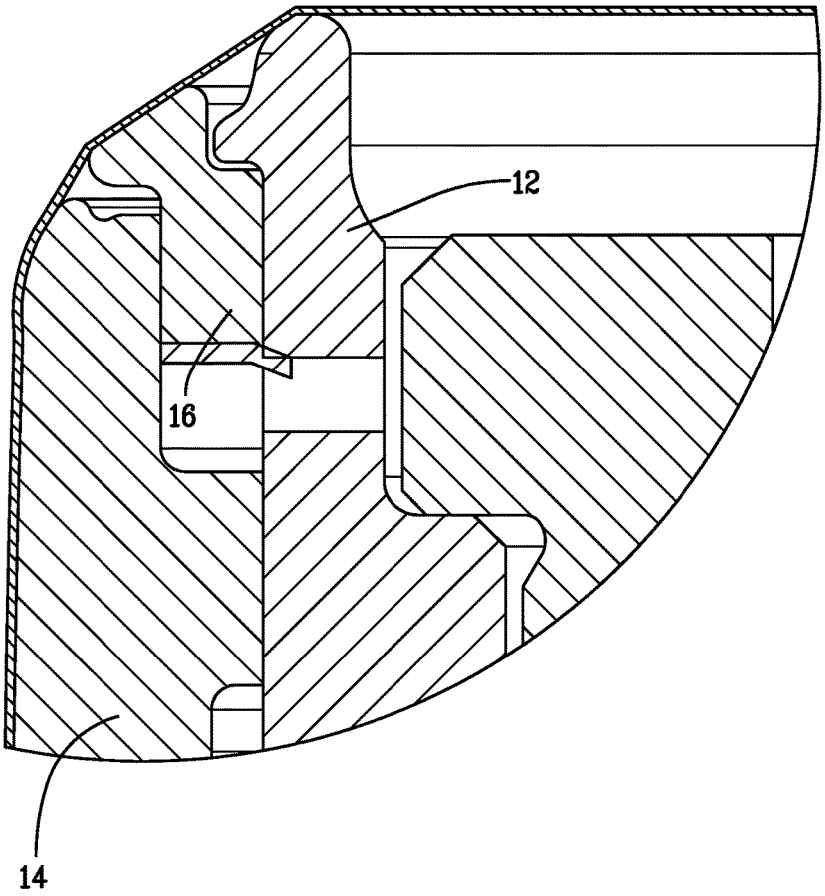
FIG. 7 is a view of the components of FIG. 3 illustrating a completed stage of the redraw operation.
Figure 8:
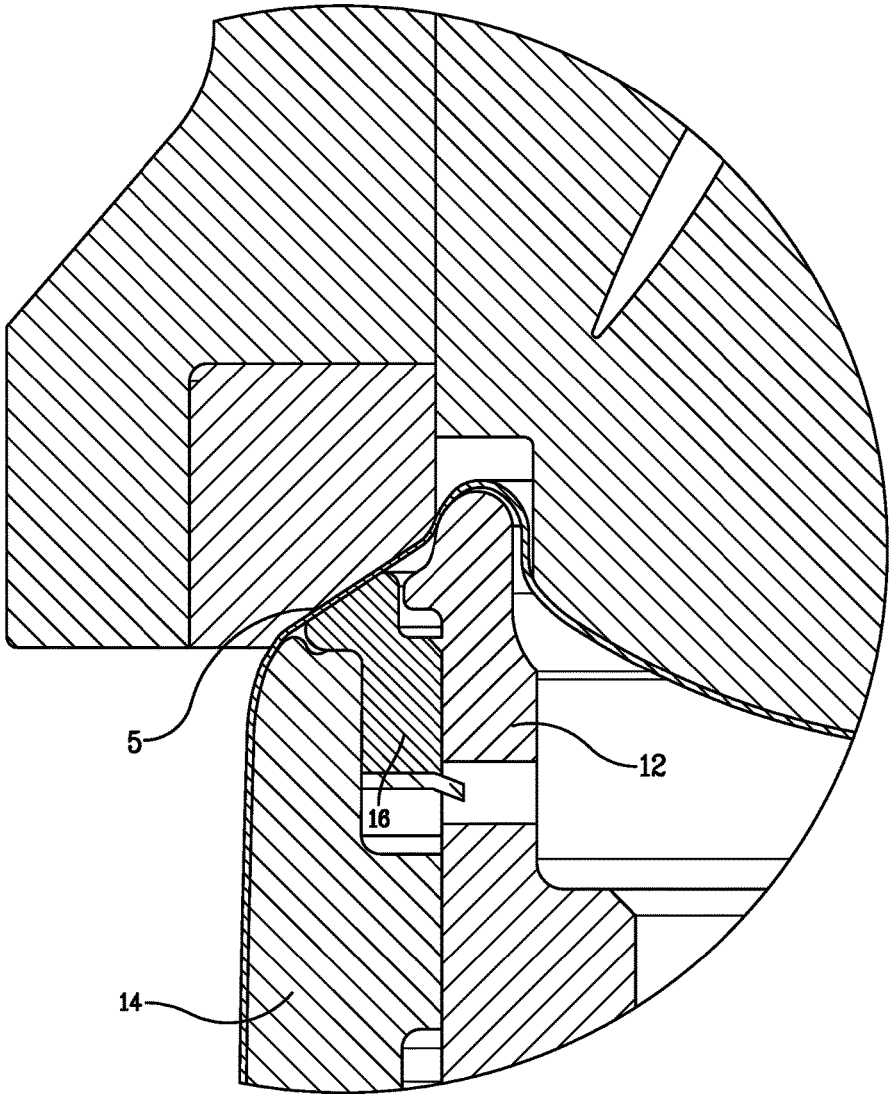
FIG. 8 is a view of the components of FIG. 3 engaged in the doming tooling.

Punch ring nose 60 or angled surface 64 is the second point of contact B with cup 2 during the drawing/redrawing process, as best shown in FIG. 5. Sleeve nose 40 or angled surface 44 then contacts cup 2 at point C, as best illustrated in FIG. 6. FIG. 7 shows the completed redrawing process, with cup 2 having bottom 4, redraw chine 5, and sidewall 106. Bottom 4 is formed between center punch nose 30, redraw chine is formed over punch ring nose 60, punch ring contact surface 64, punch sleeve nose 40, and punch sleeve contact surface 44. The sidewall 6 of cup 2 is formed over punch sleeve sidewall surface 46. Throughout the processes shown in FIGS. 4 through 7, punch ring inboard shoulder 61 may be spaced apart from undercut shoulder 25 of punch tool 12 or may be in contact with undercut shoulder 25.

Upon the end of the stroke of the ram that pushes body maker tooling 10, doming tool 210 forms a dome on cup bottom 4 and chine tool 212 contacts redraw chine 5. As chine tool 212 deforms redraw chine 5, punch ring 16 is pushed backwards against the force of spring plate 76 until undercut shoulder 65 of punch ring 16 contacts land 43 of punch sleeve 14, as chine 5 is approximately linear between punch sleeve surface 46 or 44 and the curved portion of punch tool 16 where a radial deformation of chine 5 is formed. Thus, punch ring 16 supports the metal of redraw chine 5 to diminish wrinkling during the redrawing operation, and also possibly during the ironing operations, and then punch ring 16 retracts or is displaced by the doming tooling to enable formation of the chine.

Referring to FIGS. 9 through 13 to illustrate a second embodiment, tooling assembly 10' includes a center punch tool 12', a punch sleeve 14', a punch ring 16', and a compliant support. Center punch tool 12' has circular, ring-like punch tool nose 20' at its forwardmost or distal most end. Center punch tool 12' has a hollow recess (not shown in the figures) radially inboard of nose 20' to receive doming tooling during the doming operation. The distal end of punch tool nose 20' forms a nose tip 22' about which the standing ring of the beverage can base is formed, a nose outer surface 24' that extends radially outwardly and rearward or proximally from tip 22', a cylindrical center punch tool outer surface or sidewall 26' that extends rearwardly from nose outer surface 24', and circumferential recess, such as groove 2' 8 formed in punch sidewall 26'.

Punch sleeve 14' preferably is fixed relative to punch 12' such that the sleeve 14' and punch 12' to the extent that punch 12' and sleeve 14' move together in the bodymaker. Punch sleeve 14' includes a distal punch sleeve nose 40', a punch sleeve inner cylindrical surface 42', a punch sleeve outer cylindrical surface 46', and a punch sleeve cutout 48'. A proximal portion of punch sleeve inner cylindrical surface 42' is in contact with or corresponds to a portion of center punch outer surface 26'. Sleeve inner surface 46 also includes a forward-facing shoulder on which a proximal end of center punch 12' is located.

Punch sleeve outer cylindrical surface 46' extends distally to yield to angled contact surface 44'. A distal portion of punch sleeve 14' has a greater diameter than that of a proximal portion of punch sleeve 14' such that a cutout 48' is formed, which together with the outer surface 26' of the center punch tool forms a recess 50' for receiving punch ring 16'.

Punch ring 16' preferably has an overall ring-like or cylindrical shape and includes a nose 60', an inner surface 62', an angled surface 64', an outer surface 66', and a recess 68'. Punch ring inner surface 62' preferably is cylindrical and is in sliding contact with or corresponds to a distal surface of center punch outer surface 26'. Punch ring inner surface 62' extends distally to rounded punch nose 60'. Angled surface 64 extends radially outwardly and rearwardly from nose 60' to (preferably) cylindrical punch ring outer surface 66'. Angled surface 64' in the embodiment shown in the figures is rounded or convex outward (that is, bulging). Punch ring recess 68' is formed in an radially inboard portion of punch ring inner surface 62'. In its rest state, punch ring recess 68' has an upper and lower boundary walls that preferably are aligned with the corresponding upper and lower boundary walls of center punch recess 28'. Alternatively, the upper and lower boundary walls of recesses 68' and 28' are not aligned, as the recesses 68' and 28' overlap and in direct communication when punch ring 60' is in its rest position.

Compliant support, such a spring plate 76', has a radially inboard portion 78' that is located in center punch recess 28' and a radially outboard portion 80' that is located in punch ring recess 68'. Spring plate 76' is wavy around its circumference such that the crests 82' of the upper surface plate 76' contact the top boundary wall of recess 28' and the lower surface of the troughs 84' contact the lower boundary wall of recess 28'. Crests 82' and troughs 84' retain plate 76' in groove 28'.

As explained below, outboard portion 80' of plate 76' engages the punch ring recess 68 such that spring plate 76' locates punch ring 16' in a desired position for diminishing wrinkles during the redraw process. Because spring plate 76' is compliant, punch ring 16' can be pushed rearwardly by the doming tooling assembly as explained more fully above. The compliant support my be formed in any configuration, and encompasses any compliant material, such as an elastomer or other resilient material. Preferably the complaint support bears on the center punch tool, which preferably encompasses the compliant support contacting or being supported by the center punch tool.

Figure 9:
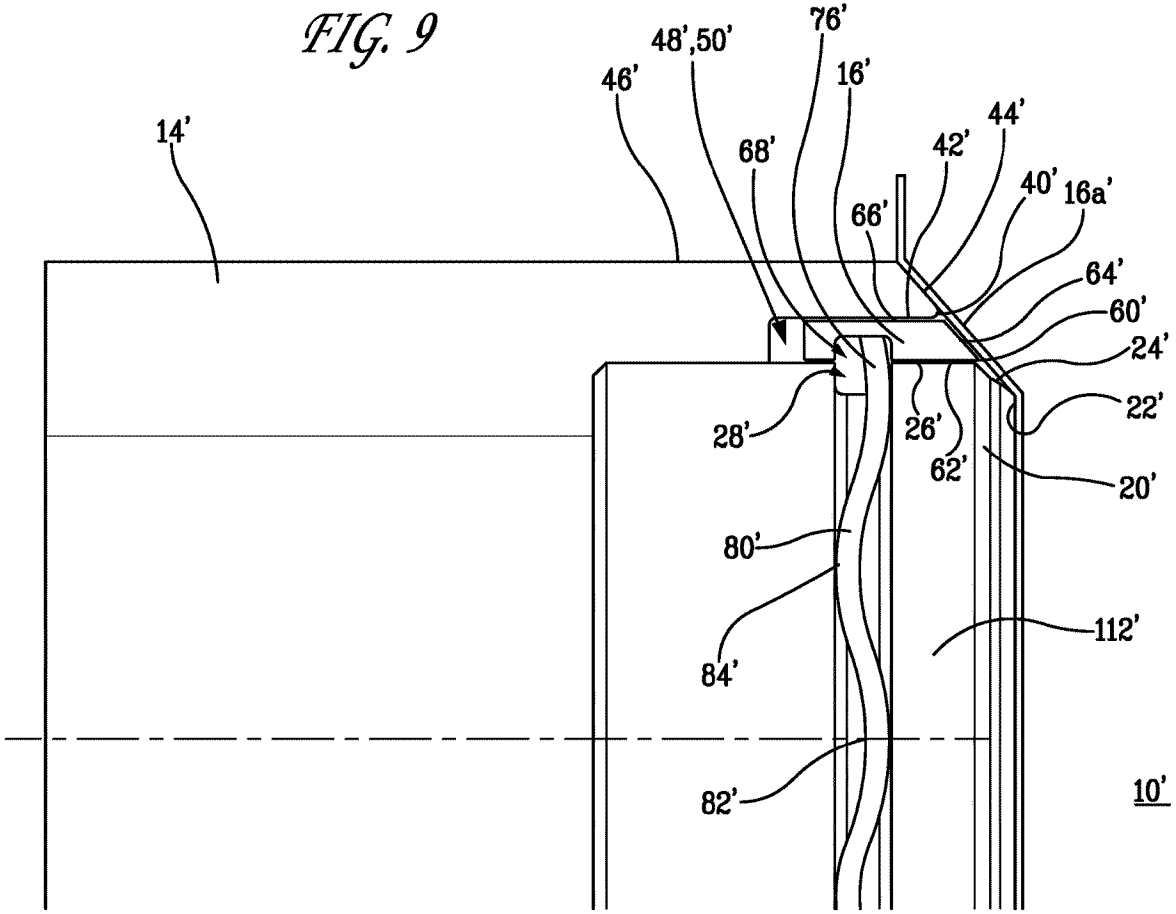
FIG. 9 is a cross sectional view of punch assembly tooling according to an embodiment of the present invention.
Figure 10:
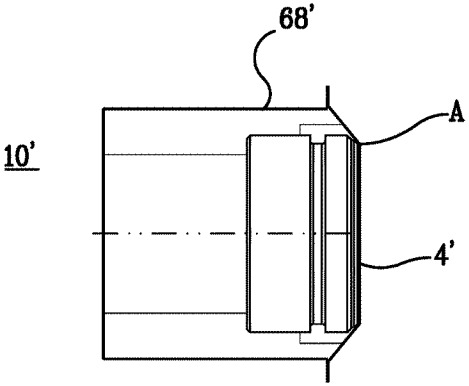
FIG. 10 is a view of the components of FIG. 9 illustrating the first point of contact point of the tooling with the can.
Figure 11:
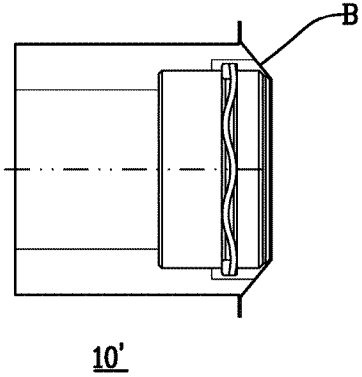
FIG. 11 is a view of the components of FIG. 9 illustrating the second contact point of the tooling with the can.
Figure 12:
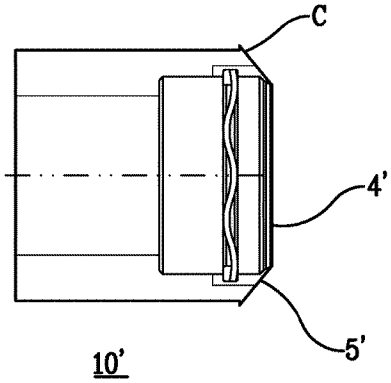
FIG. 12 is a view of the components of FIG. 9 illustrating the third contact point of the tooling with the can, showing the punch ring retracted.
Figure 13:
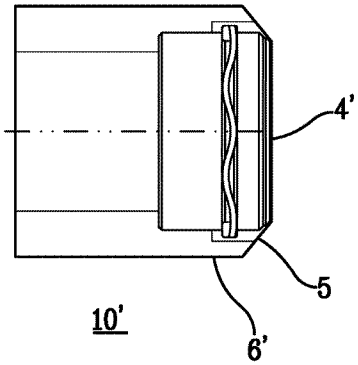
FIG. 13 is a view of the components of FIG. 9 illustrating a completed stage of the redraw operation.

Referring to FIGS. 9 through 12 to illustrate the operation of tooling 10' during a drawing or redrawing step, center punch nose 20' moves forward relative to cup 2' until it engages a bottom of the cup 2' to begin the drawing/redrawing process. FIG. 9 illustrates the first point A at which the tooling at punch nose 20' touches or engages the can bottom 4'. Punch ring nose 60' or angled surface 64' is the second point of contact B with cup 2' during the drawing/redrawing process, as best shown in FIG. 10. Sleeve nose 40' or angled surface 44' then contacts cup 2' at point C, as best illustrated in FIG. 11. FIG. 12 shows the completed redrawing process, with cup 2' having bottom 4', redraw chine 5', and sidewall 6'. Bottom 4' is formed between center punch nose 30', redraw chine 5' is formed over punch ring nose 60', punch ring contact surface 64', punch sleeve nose 40', and punch sleeve contact surface 44'. The sidewall 6' of cup 2' is formed over punch sleeve sidewall surface 46'.

Upon the end of the stroke of the ram that pushes body maker tooling 10', doming tooling forms a dome in the can and urges punch ring 16 rearward, as generally described for first embodiment tooling 10. The doming tool forms a dome on cup bottom and chine tool contacts redraw chine. As the chine tool deforms redraw chine, punch ring 16' is pushed backwards against the force of spring plate 76'. Thus, punch ring 16' supports the metal of redraw chine 5' to diminish wrinkling during the redrawing operation, and also possibly during the ironing operations, and then punch ring 16' retracts or is displaced by the doming tooling to enable formation of the chine.

The first and second embodiments 10 and 10' are illustrated with the forwardmost point of the punch tool nose 20 located forward (that is, forward or relatively distal along an axial centerline of the tooling, without regard to radial position) of the forwardmost portion of the punch ring nose 60 such that tooling 10 and 10' contacts the workpiece in the sequence at point A, then point B, then point C. The present invention is not limited to this configuration of tooling 10 and 10' nor the order of contact with the workpiece.

Figure 3A:
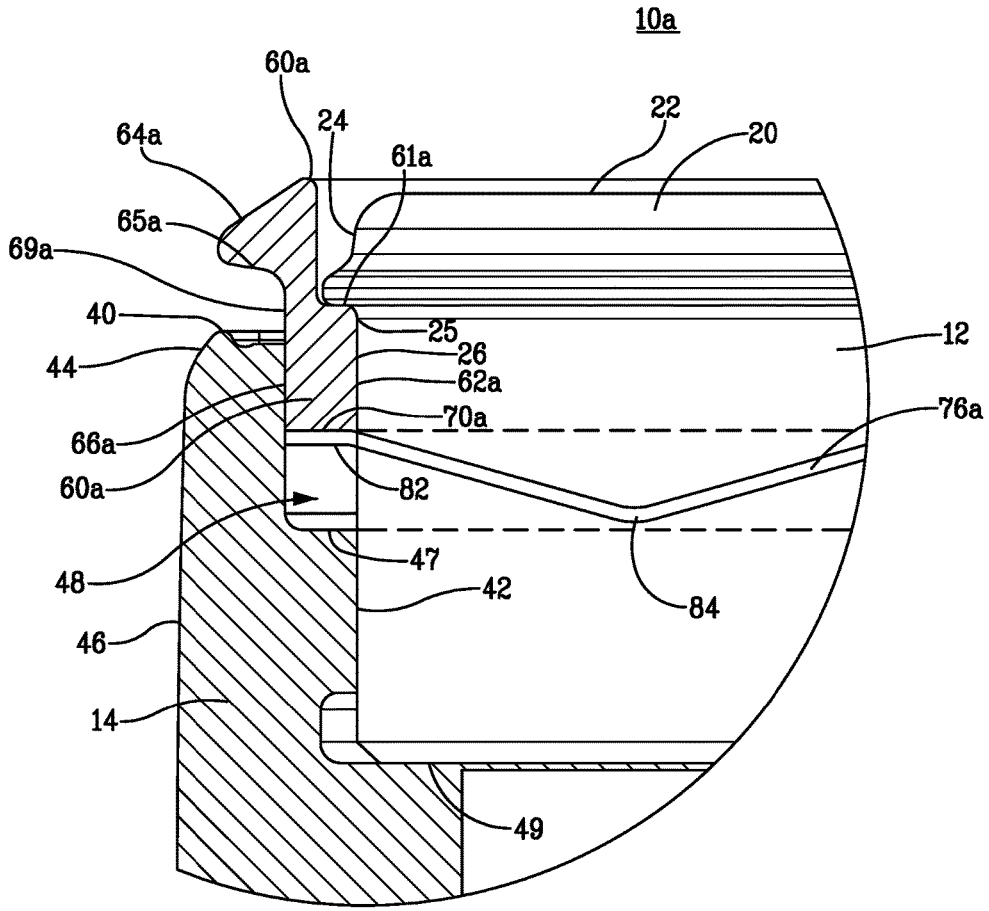
FIG. 3*a* is a cross sectional view of punch assembly tooling according to another embodiment of the punch ring.

Rather, the present invention encompasses a structure in which the forwardmost portion of the punch ring nose is forward of the punch tool nose 20 such that the punch ring contacts the workpiece before punch tool 12 contacts the workpiece. For example, as shown in FIG. 3*a*, tooling 10*a* includes an alternative embodiment punch ring 16*a*. Punch ring 16*a* has an overall ring-like shape and includes a nose 60*a*, an inboard shoulder 61*a*, an inner surface 62*a*, an angled surface 64*a*, an undercut shoulder 65*a*, an outer surface 66*a*, and elongate neck 69*a*, and a rear surface 70*a*. The base of punch ring 16*a* is made up of punch ring inner surface 62*a*, inboard shoulder 61*a*, and rear surface 70*a*, which are as described with respect to first embodiment punch ring 16. Further, the head of the punch ring 16*a* is made up of nose 60*a*, angled contact surface 64*a*, and undercut shoulder 65*a*, which preferably have the same shape as corresponding structure of first embodiment punch ring 16. The head of the punch ring 16*a* extends distally or forward from the base of punch ring 16*a* to form elongated neck 69*a* such that nose 60*a* is located forward of nose 22 of punch tool 12. The punch tool 12 and punch sleeve 14 are as described for first embodiment tooling 10.

Thus, the first portion of the tooling 10*a* that contacts a metal cup during redrawing is nose 60*a* of punch ring 16*a*, which then retracts against spring 76. As will be understood by persons familiar with container tooling technology, spring 76 may be chosen to provide resistance for anti-wrinkling without significant deforming of the chine wall. The dimensions of recess 48 may be chosen to provide sufficient space for punch ring 16*a* to retract consistent with the structure and function described herein.

The second embodiment tooling 10' may also accept an alternative punch ring 16*a'* that extends forward of the punch tool nose 22' according to the same principles described above for punch ring 16*a*. Punch ring 16*a'* is illustrated by dashed lines in FIG. 9. The remainder of tooling 10' may be configured to provide sufficient space for punch ring 16*a'* to retract (not shown in FIG. 9) consistent with the structure and function described herein.

The above disclosure describes an embodiment of the invention. The invention is not intended to be limited to the particular structure or function of the components disclosed described herein, but rather it is intended to encompass the full scope recited in any claims.

The invention claimed is:

1. A redrawing tooling assembly in a can bodymaker for redrawing a metal cup, the can body maker including doming tooling, the redrawing tooling assembly comprising:

a center punch tool having a forwardmost annular tip adapted for concentric contact with a base of a metal cup;

a punch sleeve that is concentric with the center punch tool, the punch sleeve has a contact surface that is axially located rearward of the center punch tool forwardmost tip such that the metal cup has a chine wall therebetween during the redrawing process;

a punch ring concentric with the center punch tool, the punch ring is outboard of at least a portion of the center punch tool and inboard of at least a portion of the punch sleeve, the punch ring includes an undercut shoulder on an outboard side, the punch ring has a contact surface that is radially located between the center punch tool forwardmost tip and the punch sleeve contact surface, the punch ring contact surface is adapted to contact the chine wall of the metal cup during the redraw process; and a compliant support that is configured to axially position the punch ring contact surface to contact the chine wall of the metal cup during the redrawing process to inhibit metal wrinkling, the compliant support is adapted to retract in response to the punch ring engaging the doming tooling in the bodymaker, thereby enabling the punch ring contact surface to retract relative to the center punch tool.

2. The redrawing tooling assembly of claim 1 wherein the punch ring is axially moveable relative to the center punch tool.

3. The redrawing tooling assembly of claim 1 wherein the forwardmost tip of the center punch tool is forward of a forwardmost portion of the punch ring contact surface such that the punch ring engages the metal cup after the center punch tool, and the punch sleeve engages the metal cup after the punch ring.

4. The redrawing tooling assembly of claim 3 wherein the punch ring contact surface is adapted to contact the chine wall at an angled portion of the chine.

5. The redrawing tooling assembly of claim 4 wherein the punch ring includes (i) an angled contact surface configured to contact the chine wall of a can and (ii) an inboard shoulder that is urged against an undercut shoulder of the punch tool by the compliant support.

6. The redrawing tooling assembly of claim 1 wherein the compliant support extends circumferentially around a portion of the center punch tool and contacts a base of the punch ring to urge the punch ring forward.

7. The redrawing tooling assembly of claim 1 wherein the punch ring undercut shoulder is configured to contact a land surface of the punch ring in a fully retracted position of the punch ring.

8. The redrawing tooling assembly of claim 1 wherein the compliant support is retained by a groove in the center punch tool.

9. The redrawing tooling assembly of claim 1 wherein the compliant support bears on a portion of the center punch tool.

10. The redrawing tooling assembly of claim 1 wherein the compliant support is a spring plate.

11. The redrawing tooling assembly of claim 1 wherein the compliant support includes a resilient elastomer.

12. A redrawing tooling assembly in a can bodymaker for redrawing a metal cup, the can body maker including doming tooling, the redrawing tooling assembly comprising:

a center punch tool having a forwardmost annular tip adapted for concentric contact with a base of a metal cup;

a punch sleeve that is concentric with the center punch tool, the punch sleeve has a contact surface that is axially located rearward of the center punch tool forwardmost tip such that the metal cup has a chine wall therebetween during the redrawing process;

a punch ring concentric with the center punch tool, the punch ring is outboard of at least a portion of the center punch tool and inboard of at least a portion of the punch sleeve, the punch ring has a contact surface that is radially located between the center punch tool forwardmost tip and the punch sleeve contact surface, the punch ring contact surface is adapted to contact the chine wall of the metal cup during the redraw process; and a compliant support that is configured to axially position the punch ring contact surface to contact the chine wall of the metal cup during the redrawing process to inhibit metal wrinkling, the compliant support is adapted to retract in response to the punch ring engaging the doming tooling in the bodymaker, thereby enabling the punch ring contact surface to retract relative to the center punch tool, wherein a forwardmost portion of the punch ring contact surface is forward of the forwardmost tip of the center punch tool is such that the punch ring engages the metal cup before the center punch tool, and the punch sleeve engages the metal cup after the punch ring.

13. A method of forming a metal can body comprising the steps of:

redrawing a metal cup including:

contacting a bottom of the cup with a concentric center punch tool; and contacting a chine wall of the metal cup with a punch ring to inhibit wrinkling of the chine wall, the punch ring having compliant support;

(ii) ironing the sidewall by pushing the center punch tool through ironing rings; and (iii) forming a dome in the bottom of the cup including contacting the bottom of the cup with doming tooling, the doming tooling compressing the compliant support retracting the punch ring until an outboard undercut surface of the punch ring contacts a land surface of a punch sleeve.

14. The method of forming a metal can body of claim 13 wherein the step of contacting a bottom of the cup with the concentric center punch tool includes reducing the diameter of the metal cup and forming an angled chine wall between the bottom of the metal cup and a sidewall of the metal cup.

15. The method of forming a metal can body of claim 14 wherein the step of contacting the wall of the metal cup with the punch ring includes contacting the angled chine wall of the metal cup with the punch ring to inhibit wrinkling of the angled chine wall.

16. The method of forming a metal can body of claim 15 wherein the redrawing step further includes contacting the angled chine wall with an angled contact surface of the punch ring, the punch ring being concentric with the center punch tool.

17. The method of forming a metal can body of claim 15 wherein the punch ring contacts the metal cup after the center punch tool, and a punch sleeve contacts the metal cup after the punch ring.

18. The method of forming a metal can body of claim 13 wherein the punch ring contacts the metal cup before the center punch tool.

19. The method of forming a metal can body of claim 13 wherein the ironing step further includes contacting the sidewall with the punch sleeve.

20. The method of forming a metal can body of claim 13 wherein during the redrawing step the compliant support bears on a portion of the center punch tool.

21. The method of forming a metal can body of claim 13 wherein the compliant support is a spring plate.

22. The method of forming a metal can body of claim 13 wherein the compliant support includes an elastomer.

23. The method of forming a metal can body of claim 13 wherein during the step of forming the dome the doming tooling retracts the punch ring.

24. The method of forming a metal can body of claim 13 wherein the compliant support urges an inboard shoulder of the punch ring into contact with an undercut shoulder of the punch tool until, during the redrawing step (i), the punch ring retracts relative to the punch tool.

* * * * *